US005266027A

United States Patent [19]

Kuwayama

[11] Patent Number: 5,266,027

[45] Date of Patent: Nov. 30, 1993

[54] ROLLER-HEARTH CONTINUOUS FURNACE

[75] Inventor: Hiroshi Kuwayama, Tokai, Japan

[73] Assignee: NGK Insulators, Ltd., Nagoya, Japan

[21] Appl. No.: 928,476

[22] Filed: Aug. 12, 1992

[51] Int. Cl.[5] ..... F27B 9/02

[52] U.S. Cl. ..... 432/128; 432/144; 432/246

[58] Field of Search ..... 432/236, 234, 233, 246, 432/144, 148, 128

[56] References Cited

U.S. PATENT DOCUMENTS

| | | | |
|---|---|---|---|
| 3,947,237 | 3/1976 | Leisenberg | 432/144 |
| 4,569,658 | 2/1986 | Wiggins et al. | 432/144 |
| 4,627,814 | 12/1986 | Hattori et al. | 432/128 |
| 4,773,851 | 9/1988 | Mueller | 432/144 |

FOREIGN PATENT DOCUMENTS 2-21187 1/1990 Japan .

*Primary Examiner*—Henry C. Yuen
*Attorney, Agent, or Firm*—Shea & Gould

[57] ABSTRACT

The roller-hearth continuous furnace of the present invention comprises a tunnel-shaped furnace housing provided with a larger number of rollers shielded from outside, the inside of the furnace being divided into a heating section, a soaking section and a cooling section in this order with the heating section located close to the inlet of the furnace housing. The cooling section has a means for feeding of atmosphere-controlling gas and a means for detection of furnace inside pressure. The heating section has a means for forced gas exhaustion, capable of sucking a furnace inside gas correspondingly to the furnace inside pressure detected by said means for detection of the pressure. The present roller-hearth continuous furnace having the above constitution ensures cooling in a stable atmosphere and can provide household or industrial ceramic wares of stable quality.

4 Claims, 2 Drawing Sheets

ROLLER-HEARTH CONTINUOUS FURNACE

BACKGROUND OF THE INVENTION AND RELATED ART STATEMENT

The present invention relates to a roller-hearth continuous furnace used for ceramic firing for production of household or industrial ceramic wares.

When ceramic firing must be conducted in a non-oxidizing atmosphere for production of household or industrial ceramic wares, there have been mainly used single furnaces of electrical heating type. Recently, however, use of continuous furnace such as roller-hearth furnace of gas heating type has been investigated in order to improve the productivity and economy of said single furnaces.

When a roller-hearth continuous furnace is used for ceramic firing for production of, for example, ceramic wares requiring controlled atmosphere firing, gas burners are allowed to produce reducing flames in the firing section, whereby the firing section, etc. inside the furnace are kept in a reducing atmosphere. In this furnace, however, even slight variation in said flames invites variation in furnace inside pressure or in boundary between reducing atmosphere and oxidizing atmosphere; hence, this tends to give fired products of nonuniform quality especially when the firing and quenching steps (these two steps have a large influence on the color development, etc. of fired products) must be conducted in a stable atmosphere.

Therefore, the object of the present invention is to eliminate the above-mentioned drawbacks of the prior art and provide a roller-hearth continuous furnace of gas heating type, capable of conducting the cooling step in a stable atmosphere.

SUMMARY OF THE INVENTION

According to the present invention there is provided a roller-hearth continuous furnace comprising a tunnel-shaped furnace housing provided with a large number of rollers shielded from outside, the inside of said furnace housing being divided into a heating section, a soaking section and a cooling section in this order with the heating section located close to the inlet of the furnace housing, the cooling section having a means for feeding of atmosphere-controlling gas and a means for detection of furnace inside pressure, and the heating section being provided with a means for forced gas exhaustion, capable of sucking a furnace inside gas correspondingly to the furnace inside pressure detected by said means for detection of the pressure.

DETAILED DESCRIPTION OF PREFERRED EMBODIMENT

The present invention is hereinafter described in more detail by way of an example shown in FIGS. 1 and 2.

Figure 1:
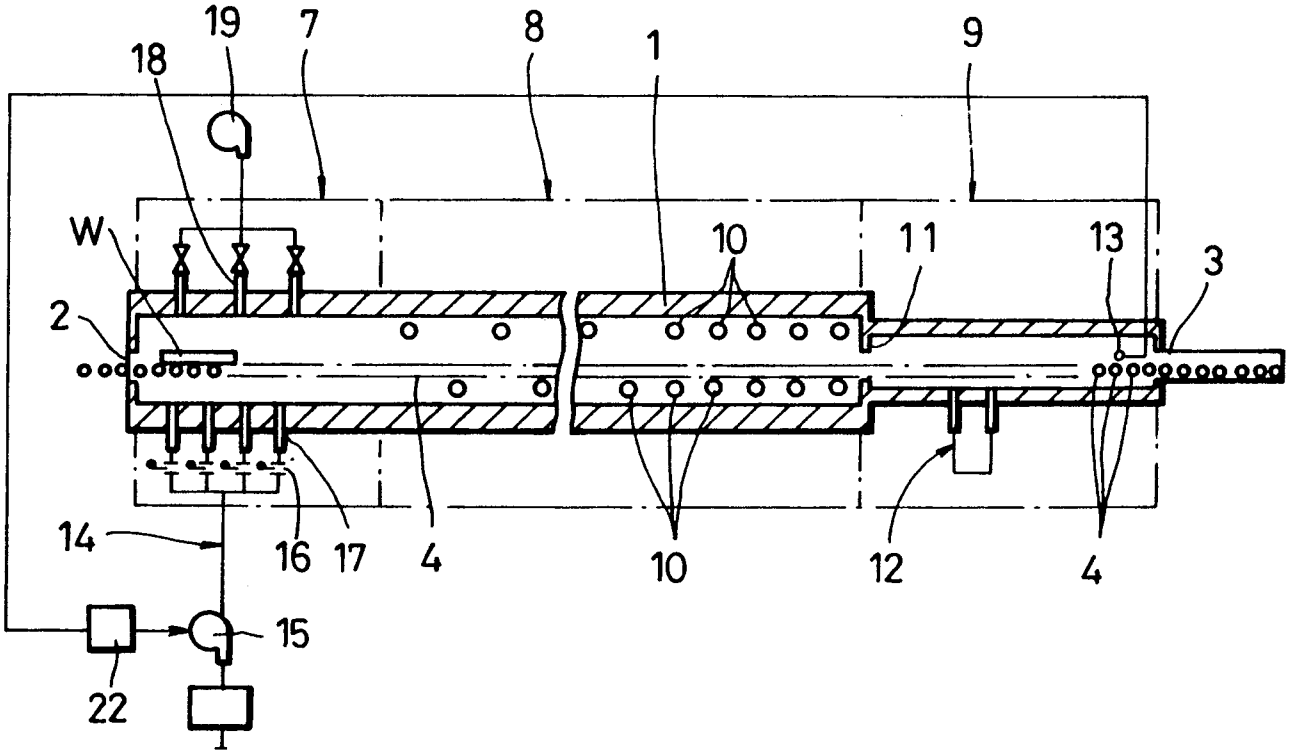
FIG. 1 is a sectional view showing an example of the present invention.

In FIG. 1, 1 is a tunnel-shaped furnace housing having an inlet 2 at the left end and an outlet 3 at the right end. Inside the furnace housing 1 and over the total length are arranged a large number of rollers 4 at given intervals. As shown in FIG. 2, each of these rollers 4 is supported at the both ends by supporting rollers 5,5 and is driven at a given speed by a sprocket 6 provided at one end, whereby a ware W to be fired, placed thereon is transferred at a given speed from the inlet 2 to the outlet 3.

The inside of the furnace housing 1 is divided into a heating section 7, a soaking section 8 and a cooling section 9 in this order with the heating section 7 located at the inlet side. The heating section 7 has no heating means (but the heating section may have a heating means in other embodiments) and is for preheating the ware W to be fired, by the heat of the combustion gas flowing thereinto from the adjacent soaking section 8. The soaking section 8 is provided with a large number of gas burners 10 and is for firing the ware W in accordance with the temperature curve preliminarily set for the ware W. The cooling section 9 has no heating means, either, and is for cooling the ware W to around room temperature. Since in the roller-hearth continuous furnace of the present invention, the cooling section 9 must be completely filled with a special atmosphere, it is preferable to install a partition wall 11 between the soaking section 8 and the cooling section 9, as shown in FIG. 1.

The cooling section is fitted with a means 12 for feeding of atmosphere-controlling gas, through which an atmosphere-controlling gas such as inert gas or oxygen gas can be fed into the cooling section 9. By feeding an inert gas (e.g. nitrogen gas) through the means 12 into the cooling section 9, at least the inside of the cooling section 9 can be kept in a non-oxidizing atmosphere; or by feeding oxygen gas, the inside of the cooling section 9 can be kept in a strong oxidizing atmosphere. The cooling section 9 is further fitted with a means 13 for detection of furnace inside pressure, capable of detecting very slight variation in furnace inside pressure, whereby the furnace inside pressure can be detected at an accuracy of, for example, about 0.1 mm $H_2O$.

Meanwhile, the heating section 7 is fitted, at the portion close to the inlet 2, with a means 14 for forced gas exhaustion, capable of sucking a furnace inside gas. The means 14 for forced gas exhaustion comprises a blower 15 and suction holes 17 connected to the suction side of the blower 15 via flow-rate-controlling valves 16. By sucking the furnace inside gas from the heating section 7 by the means 14 for forced gas exhaustion, there is formed, inside the furnace housing 1, a gas stream proceeding from the outlet 3 to the inlet 2. In the present invention, the sucking of the furnace inside gas by the means 14 for forced gas exhaustion is conducted correspondingly to the furnace inside pressure detected by the means 13 for detection of furnace inside pressure. That is, when a rise in the furnace inside pressure of the cooling section 9 is detected by the means 13 for detection of furnace inside pressure, the rpm of the blower 15 of the means 14 for forced gas exhaustion is increased by a regulator 22 to increase the amount of furnace inside gas sucked; conversely when there is a decrease in the furnace inside pressure of the cooling section 9, the rpm of the blower 15 is lowered to decrease the amount of furnace inside gas sucked. Thus, in the present example, the control of the sucked gas amount is conducted continuously by controlling the rpm of the blower 15 using an inverter. At the ceiling of the heating section 7 are arranged air-injecting holes 18 provided with flow-rate-controlling valves 17. Air blowing through the holes 18 using a blower 19 makes possible the temperature control of heating section 7.

Figure 2:
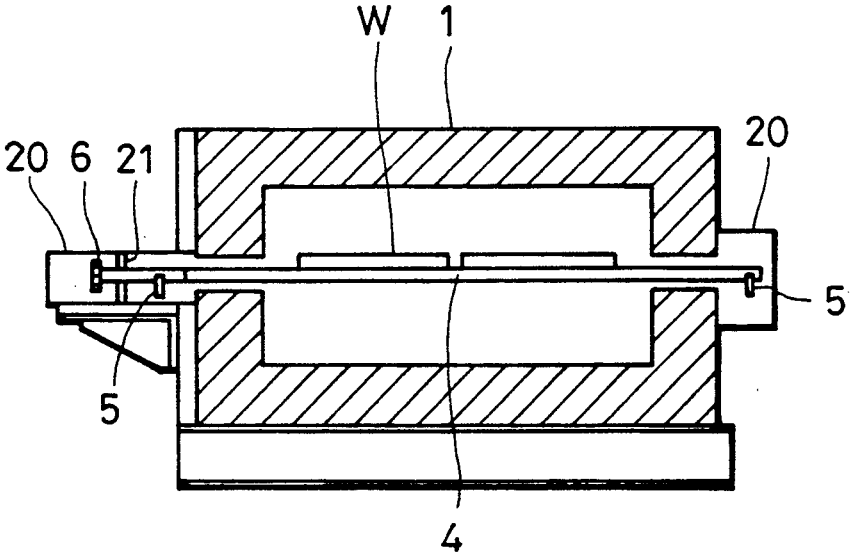
FIG. 2 is a vertical sectional view of FIG. 1.

As shown in FIG. 2, in order to prevent the incoming of outside air into the furnace through the gap between the housing 1 and each roller 4, shielding covers 20 are provided at each two ends of at least the selected rollers 4 and further a heat-resistant seal 21 is provided at the circumference of each pivot of such rollers 4 whereby the furnace inside is shielded from outside.

In the present roller-hearth continuous furnace having the above constitution, a ceramic ware W to be fired in a non-oxidizing atmosphere or a strong oxidizing atmosphere for production of a household or industrial ceramic ware, is placed on rollers 4 at the inlet 2 and transferred at a given speed by the rotation of rollers through the heating section 7, the soaking section 8 and the cooling section 9 in this order to subject the ceramic ware W to steps of preheating, firing and cooling. This procedure is not different from the conventional procedure.

In the present invention, however, part of the rollers 4 (selected rollers) are sealed from outside and the cooling section 9 is provided with the means 12 for feeding of atmosphere-controlling gas to feed an inert gas or oxygen gas into the furnace; thereby, at least the inside of the cooling section 9 is filled with the atmosphere-controlling gas and the cooling step can be conducted in a desired atmosphere. Moreover, the cooling section 9 is provided with the means 13 for detection of furnace inside pressure and the heating section 7 is provided with the means 14 for forced gas exhaustion, capable of sucking the furnace inside gas correspondingly to the furnace inside pressure detected by the means 13 for detection of furnace inside pressure; hence, for example, when the furnace inside pressure varies by the change of, for example, flames of the gas burners 10 in the soaking section 8 and resultantly, for example, the flow of the atmosphere in the cooling section 9 varies, the means 14 for forced gas exhaustion immediately controls the amount of furnace gas exhausted from the heating section 7 and this gives stable gas flow in the furnace from the cooling section 9 to the heating section 7. For these reasons, with the roller-hearth continuous furnace of the present invention, the cooling step can be carried out in a strictly controlled stable atmosphere without being affected by outside perturbation.

As described above, the roller-hearth continuous furnace of the present invention can allow the cooling step to proceed in a stable atmosphere and thereby can provide household or industrial ceramic wares of stable quality; further, with the present furnace, ceramic firing can be conducted in a large amount and economically. Thus, the present roller-hearth continuous furnace is free from the problems of the prior art and greatly contributes to industrial development.

What is claimed is:

1. A roller-hearth continuous furnace comprising a tunnel-shaped furnace housing provided with a large number of rollers shielded from outside, the inside of said furnace housing being divided into a heating section, a soaking section and a cooling section in this order with the heating section located close to the inlet of the furnace housing, the cooling section having a means for feeding of atmosphere-controlling gas and a means for detection of furnace inside pressure, and the heating section being provided with a means for forced gas exhaustion, capable of sucking a furnace inside gas correspondingly to the furnace inside pressure detected by said means for detection of the pressure.

2. A roller-hearth continuous furnace according to claim 1, wherein each two ends of the selected rollers are provided with shielding covers and the circumferences of the pivots of these rollers are provided with heat-resistant seals to shield the furnace inside from outside.

3. A roller-hearth continuous furnace according to claim 1, wherein a partition wall is provided between the soaking section and the cooling section.

4. A roller-hearth continuous furnace according to claim 1, wherein the means for forced gas exhaustion comprises a blower and suction holes connected to the suction side of the blower via flow-rate-controlling valves.

* * * * *